US008025487B1

(12) United States Patent
Paul, III

(10) Patent No.: US 8,025,487 B1
(45) Date of Patent: Sep. 27, 2011

(54) ROD ARM BAFFLE APPARATUS

(76) Inventor: William Paul, III, Stratford, OK (US)

( * ) Notice: Subject to any disclaimer, the term of this patent is extended or adjusted under 35 U.S.C. 154(b) by 1072 days.

(21) Appl. No.: 11/894,176

(22) Filed: Aug. 20, 2007

(51) Int. Cl.
*F04B 53/00* (2006.01)

(52) U.S. Cl. ..... 417/254; 92/141; 277/511

(58) Field of Classification Search ..... 417/254; 92/141; 184/6.5, 6.27; 403/1; 277/496–499, 277/511
See application file for complete search history.

(56) References Cited

U.S. PATENT DOCUMENTS 1,400,672 A * 12/1921 Frank ..... 277/458
1,421,202 A * 6/1922 Ford ..... 277/497
1,581,255 A * 4/1926 Watts ..... 92/141
1,647,361 A * 11/1927 Hufnagle ..... 92/141
1,813,998 A * 7/1931 Hobart ..... 417/307
4,163,723 A 8/1979 Romano
4,204,810 A 5/1980 Vogel
4,721,444 A 1/1988 Pajera
5,087,057 A * 2/1992 Kurkowski ..... 277/497
5,149,252 A 9/1992 Tuckey
5,482,117 A 1/1996 Kolpak
5,960,700 A 10/1999 Staggs
6,397,987 B1 * 6/2002 Pesch et al. ..... 188/322.22

* cited by examiner

*Primary Examiner* — Devon C Kramer
*Assistant Examiner* — Philip Stimpert
(74) *Attorney, Agent, or Firm* — Randal D. Homburg

(57) ABSTRACT

An improved baffle for a pony rod arm of a two cycle reciprocating pump having a gear end containing gear oil and a fluid end channeling oilfield fluids, provides a spiral cut expanded baffle which may be expanded to be installed on a pony rod arm of the pump without requiring the disassembly of the pump to install the baffle on the rod arm, the expanded baffle compressed and attached together subsequent to installation on the rod arm, the baffle slidably engaging the rod arm to strip the rod arm of liquid residue to prevent contamination of the gear end and the gear oil by the oilfield fluids.

1 Claim, 3 Drawing Sheets

ROD ARM BAFFLE APPARATUS

CROSS REFERENCE TO RELATED APPLICATIONS

None

BACKGROUND OF THE INVENTION

1. Field of Invention

An improved baffle for a pony rod arm of a two cycle reciprocating pump having a gear end containing gear oil and a fluid end channeling oilfield fluids, provides a spiral cut expanded baffle which may be expanded to be installed on a pony rod arm of the pump without requiring the disassembly of the pump to install the baffle on the rod arm, the expanded baffle compressed and attached together subsequent to installation on the rod arm, the baffle slidably engaging the rod arm to strip the rod arm of liquid residue to prevent contamination of the gear end and the gear oil by the oilfield fluids.

2. Description of Prior Art

The following United States patents were discovered and are disclosed within this application for utility patent. All relate to some form of a baffle. U.S. Pat. No. 4,163,723 to Romano discloses a liquid-solid separator having anti-swirl baffle to reduce turbulence in a vessel, the baffles disclosed as internal projections within the vessel. A replaceable piston seal is indicated in U.S. Pat. No. 5,960,700 to Staggs, which is disclosed as a polymeric piston seal constructed with slight tolerances to enhance the interference fit within a corresponding cylinder liner on a mud pump to wipe the cylinder wall to prevent seepage of drilling mud between the seal and the cylinder wall.

The present baffle is an improvement to prior art baffles within two cycle reciprocating pumps, as represented in FIGS. 1-4 of the drawings.

SUMMARY OF THE INVENTION

In the oil and gas industry, during the drilling and production process of oil and gas, a large amount of fluids are required for injection into the well. In order to evacuate channel and direct such fluids, a two cycle reciprocating pump is provided to remove wastewater from a storage tank where it can be later disposed of accordance with environmental standards. Within a very elementary diagram of the two cycle pump, shown in FIG. 1 of the drawings below, a first end of the pump is defined for purposes of illustration as a gear end, which is an oil filled compartment within which the pump shaft or a gear rotates and provides the reciprocating movement to base ends of one or more piston arms rotatably attached to the pump shaft by a piston rod collar. A second end is defined as a fluid end, which is a compartment within which a plunger is connected to a plunger end of the piston arms to draw and redirect oilfield fluids into the fluid end thereby creating pressure to dispose of waste fluids into a disposal or injection well. The rod arm is threadably connected to the plungers.

A baffle is located on each piston arm, often referenced in the oilfield as a "pony rod". The baffles, being made of a rubber or plastic polymer, have a tendency to wear out during the operation of the pump, and serve the purpose of "wiping" the rod arm to clear it of any residual fluids prior to the base end of the piston rod entering the gear end of the pump. Having fluids within the gear end of the pump can cause the pump to wear out as fluids in the gear end will cause the gear end and all moving parts to wear and break, rust or deteriorate. The baffles, having an internal diameter bore slightly larger than the outer diameter of the piston arm, slides up and down each piston arm, wiping any residual liquid from the arm prior to the rod arm's entry into the oil filled compartment of the gear end.

The present baffles are simple cast components, shown in FIGS. 2-4, generally embodied as a disk having a reinforced central portion defining a piston arm bore and an outer disk portion, which in some cases defines an outward overall taper, as indicated in FIG. 3. The method used to remove and replace these baffles requires removal by either cutting the baffle off or dismantling the pump to remove the piston arms from either the piston rod collar or the plungers, removing the old worn baffle and sliding the new replacement baffle over the end of each piston arm and reassembling the pump prior to renewing operation of the pump. This disassembly is very time consuming and requires great strength and several tools to conduct the baffle replacement.

Using the improved baffle apparatus, the worn baffle would simply be cut from the shaft of the piston arm using a cutting tool and the improved baffle apparatus would be expanded and turned to install the baffle upon the shaft of the piston arm until the central bore of the baffle was upon the shaft, compressing the baffle and attaching the spiral surfaces together using an attaching means, which could be an adhesive or a mechanical fastening means including a rivet, a nut and bolt or a locking pin, or a combination of an adhesive and a mechanical means. This would significantly reduce the amount of time the pump would be inoperable during repair, as no disassembly of the pump mechanism is required and no heavy objects or tools would be required to replace the worn baffle.

The subject pumps are all generally defined as ABFE (advisory base flood elevation) pumps, which extract water from the storage tank above the ground into the well with force. The two cycle pumps most often encountered by the applicant have been manufactured under the names Gaso, National Oilfield, Aplex, Oilwell, Tritan, Wheatley, Gardner Denver, Bethlehem and Union, two cycle pumps, specifically the smaller pumps including the National Oilfield ABFE J250M, J165M and J100M, all three of these pumps containing the subject baffle and the prior art baffle which is being replaced by the subject baffle.

The primary objective of the improved baffle for a two cycle reciprocating pump is to provide an easily exchanged baffle which would not require disassembly of the pump components. A second objective is to provide the baffle made of a material that is moderately resilient and resistant to salt water, fluids, drilling mud and gear or lubricating oil, including polymeric plastics and rubber, which may be glued together by a fast setting adhesive. A third objective is to provide the baffle of a material which may be flexible enough to be expanded along the spiral cut portion to allow the baffle to be rotated or screwed upon the piston rod of the pump and compressed together and fastened along the spiral cut portion to serve the intended purpose of the prior art baffle being replaced by the improved baffle.

DESCRIPTION OF THE DRAWINGS

The following drawings are submitted with this utility patent application.

DESCRIPTION OF THE PREFERRED EMBODIMENT

Figure 1:
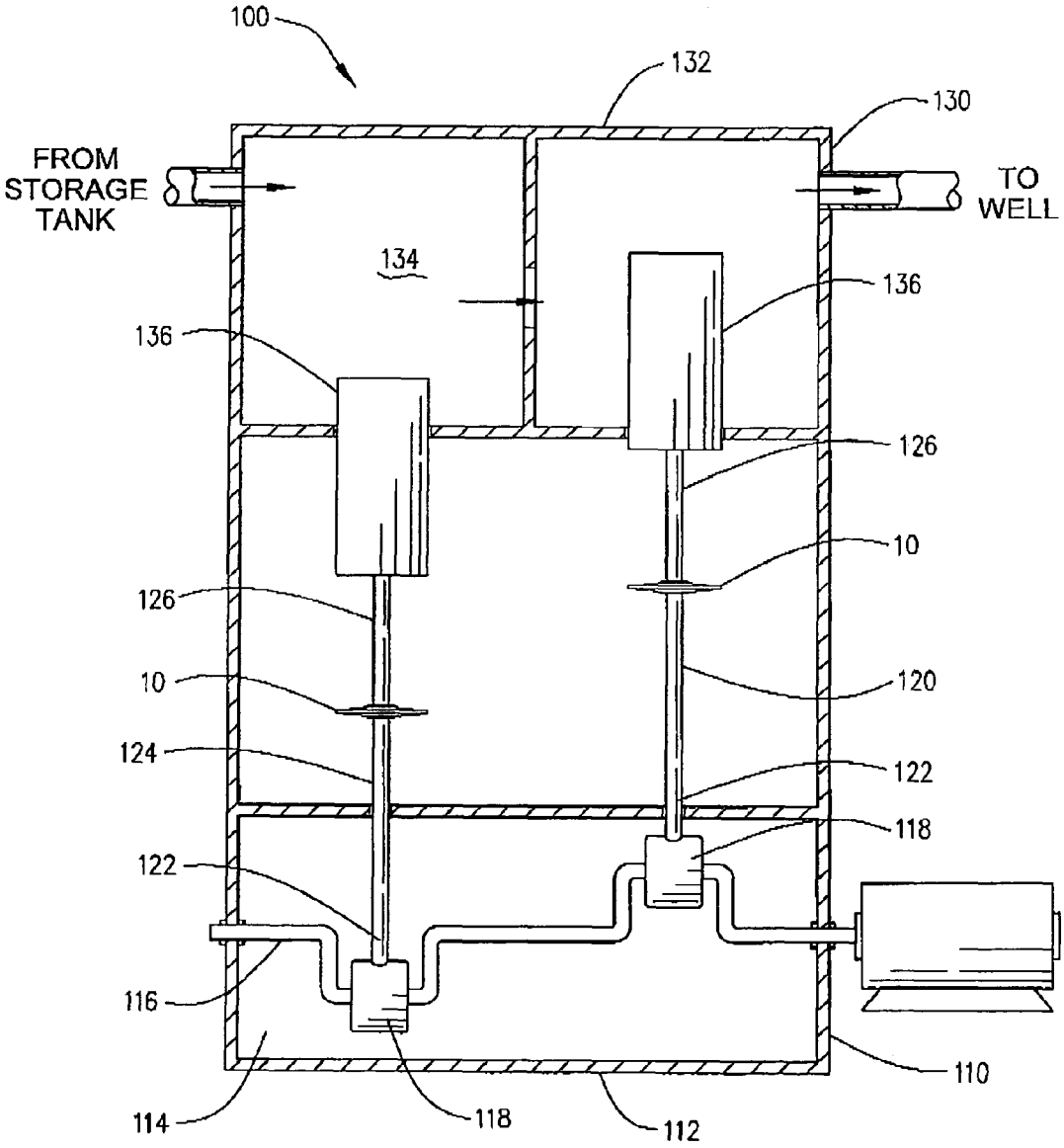
FIG. 1 is a diagram of a two cycle reciprocating pump having a pair of piston rods upon which a prior art or improved baffle is placed.
Figure 2:
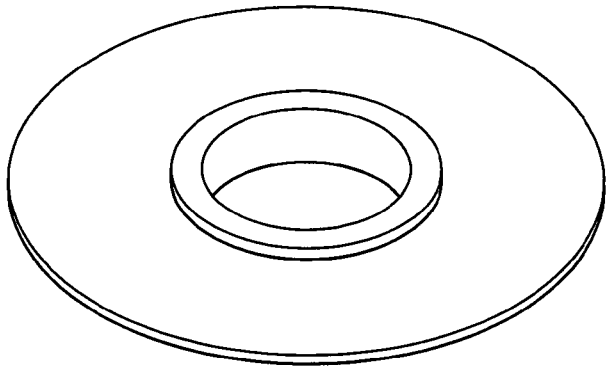
FIG. 2 PRIOR ART
FIG. 2 is a perspective view of a prior art baffle.
Figure 3:
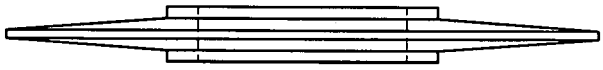
FIG. 3 PRIOR ART
FIG. 3 is a side view of the prior art baffle.
Figure 4:
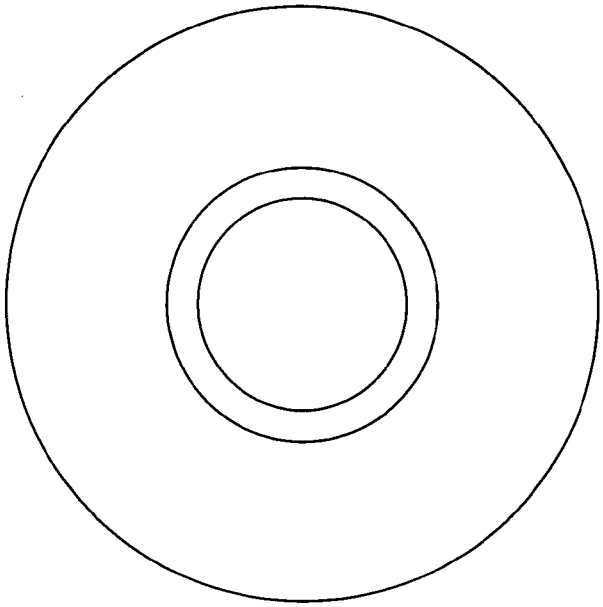
FIG. 4 PRIOR ART
FIG. 4 is a top view of the prior art baffle.
Figure 5:
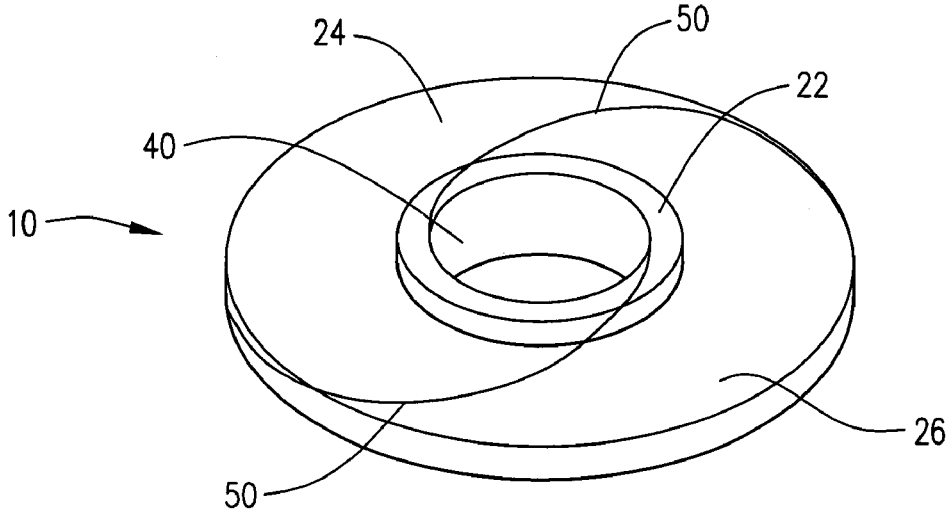
FIG. 5 is a perspective view of the improved baffle.
Figure 6:
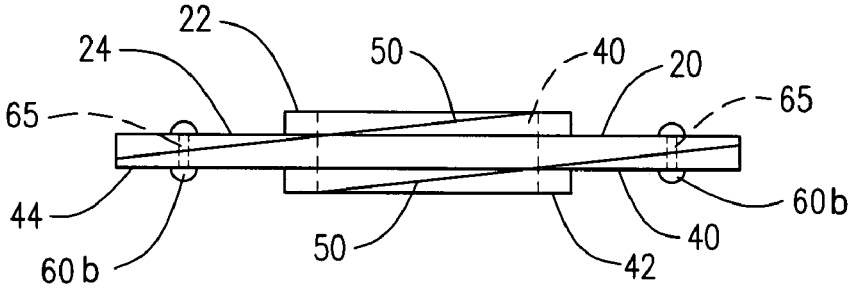
FIG. 6 is a side view of the improved baffle.
Figure 7:
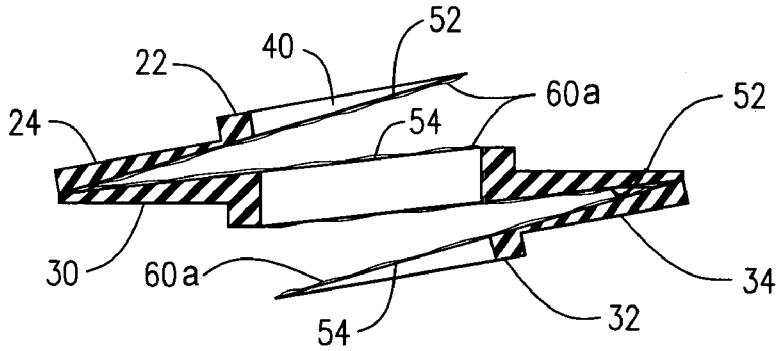
FIG. 7 is an expanded side cross-sectional view of the improved baffle along section lines 7/7 of FIG. 5.

An improved baffle 10 for an oilfield fluid pump 100, most often a two cycle reciprocating pump used in oilfield production for forcefully injecting fluids from a fluid storage tank into a well, the reciprocating pump, as indicated in FIG. 1, generally having a first end 110 defining a gear end 112 including an oil filled compartment 114 within which a pump shaft 116 or a gear rotates and provides a reciprocating movement to base ends 122 of a pair of piston arms 120 rotatably attached to the pump shaft 116 by a piston arm collar 118 and a second end 130 defining a fluid end 132 including a water compartment 134 within which a pair of plungers 136 are threadably connected to a plunger end 126 of each of the piston arms 120, the plungers 136 drawing and redirecting fluids from a storage tank through the fluid end 132 and into a well under force, the improved baffle 10, FIGS. 5-7, replacing an old worn baffle, FIGS. 2-4, located upon a shaft 124 of each piston arm 120, the improved baffle 10 comprising an upper surface 20 defining an upper collar 22 and an upper extension 24, a lower surface 30 defining a lower collar 32 and a lower extension 34, a central bore 40 located through the upper and lower collar 22, 32 adapted to slidably engage the shaft 124 of the piston arm 120, and a spiral incision 50 from the upper collar 22 through the lower collar 32, the spiral incision 50 defining an upper spiral margin 52 and a lower spiral margin 54, FIG. 7, said improved baffle 10 expanded along the spiral incision 50, separating the upper and lower spiral margins 52, 54 providing a space wherein the shaft 124 of the piston arm 120 may be inserted within the spiral incision 50 while the improved baffle 10 is rotated until the shaft 124 of the piston arm 120 is within the central bore 40, the upper and lower spiral margins 52, 54 of the spiral incision 50 compressed and retained together by a connecting means 60*a*, 60*b*, providing the improved baffle 10 to slidably engage the shaft 124 of each piston rod 120, as indicated in FIG. 1.

The improved baffle 10 is made of a rubber or polymeric material that is resistant to oilfield liquids, including fluids, oil and chemical used in oilfield production, similar to those materials selected for the prior art baffles. The connecting means 60*a*, 60*b* used to retain the upper and lower spiral margins 52, 54 may be an adhesive 60*a* which will bond the two margins together in a permanent manner, or it may also be a mechanical connecting device 60*b*, including rivets, a nut and bolt, or a pin placed through at least two holes 65 located axially across the central bore 40 of the improved baffle 10 and through the respective upper and lower extensions 24, 34 of the upper and lower surfaces 20, 30, as represented in FIG. 6.

The improved baffle 10, once the spiral margins 52, 54 are affixed together, should slide upon the shaft 124 of the piston arms 120 with minimal clearance to wipe the shaft 124 of any liquid materials, cleaning the piston arms 120 prior to entry into the oil filled compartment 114 in the gear end 112, eliminating any fluid contaminants which could harm the components within the gear end 112 or lead to corrosion. In the oilfield, salt water, mud, dirt, crude oil and other by-products and chemicals are commonly in and around the well and the surrounding production area. The improved baffle 10, by moving back and forth along the shaft 124 of the piston arms 120, removes any built up solid or liquid products to ensure that the oil within the oil filled compartment 114 at the gear end 112 preventing it from entry into the oil filled compartment 114, prolonging and maintaining the integrity of the operation of the gear end 112 and its components.

While the invention has been particularly shown and described with reference to a preferred embodiment thereof, it will be understood by those skilled in the art that changes in form and detail may be made therein without departing from the spirit and scope of the invention.

What is claimed is:

1. An improved baffle for an oilfield fluid pump, provided as a two cycle reciprocating pump used in oilfield production for forcefully injecting fluids from a fluid storage tank into a well, the fluid pump having a first end defining a gear end including an oil filled compartment within which a pump shaft rotates and provides a reciprocating movement to base ends of a pair of piston arms rotatably attached to said pump shaft and a second end defining a fluid end including a fluid compartment within which a pair of plungers are removably connected to a plunger end of each of said piston arms, said plungers drawing and redirecting fluids from said fluid storage tank into said fluid end and then forcefully injecting said fluid into said well, said improved baffle being located upon one of said piston arms, said improved baffle comprising:

an upper surface defining an upper collar and an upper extension, a lower surface defining a lower collar and a lower extension, a central bore located through said upper and lower collar adapted to slidably engage said piston arm, and a spiral incision from said upper collar through said lower collar, said spiral incision defining an upper spiral margin and a lower spiral margin, said improved baffle expanded along said spiral incision, separating said upper and lower spiral margins, wherein said shaft of said piston arm may be inserted within said spiral incision between said upper and lower spiral margins while said improved baffle is rotated until said shaft of said piston arm is within said central bore, said upper and lower margins of said spiral incision compressed and retained together by at least two mechanical connectors placed through at least two holes located radially across said central bore from each other of said improved baffle and through said respective upper and lower extensions of said upper and lower surfaces, bonding said upper and lower margins together subsequent to the placement of said improved baffle upon each said shaft of each said piston arm, allowing said improved baffle to slidably engage said piston arm.

* * * * *